United States Patent [19]

Winger

[11] Patent Number: 4,602,839

[45] Date of Patent: Jul. 29, 1986

[54] ELECTRICAL CONNECTOR WITH MULTIFUNCTION LOCK MEANS

[75] Inventor: James L. Winger, Warren, Ohio

[73] Assignee: General Motors Corporation, Detroit, Mich.

[21] Appl. No.: 695,477

[22] Filed: Jan. 28, 1985

[51] Int. Cl.[4] ..... H01R 13/639

[52] U.S. Cl. ..... 339/91 R; 339/206 R; 339/217 R

[58] Field of Search ..... 339/91 R, 110 R, 110 P, 339/206 R, 206 P, 217 R, 217 S

[56] References Cited

U.S. PATENT DOCUMENTS

| | | | |
|---|---|---|---|
| 3,523,269 | 8/1970 | Witek, Jr. et al. | 339/91 R |
| 3,544,951 | 12/1970 | Roberts | 339/91 R |
| 3,933,406 | 1/1976 | Cameron et al. | 339/91 R |
| 3,997,234 | 12/1976 | Worman | 339/105 |
| 4,045,110 | 8/1977 | Sterken | 339/91 R |
| 4,062,610 | 12/1977 | Doty et al. | 339/75 M |
| 4,066,325 | 1/1978 | Pearce, Jr. et al. | 339/176 MP |
| 4,433,888 | 2/1984 | Winger | 339/91 R |
| 4,448,477 | 5/1984 | Gladd et al. | 339/258 RR |

*Primary Examiner*—John McQuade
*Attorney, Agent, or Firm*—F. J. Fodale

[57] ABSTRACT

An electrical connector has an improved multifunction lock means which comprises a first lock piece having a thumb operator release lever to facilitate unlatching the electrical connector from a mating electrical connector, and a second lock piece having a trigger grip to facilitate disconnecting the unlatched electrical connector from the mating electrical connector.

5 Claims, 3 Drawing Figures

ELECTRICAL CONNECTOR WITH MULTIFUNCTION LOCK MEANS

This invention relates generally to electrical connectors and more particularly to electrical connectors which have a separate lock piece which is attached to a connector body to prevent the withdrawal of terminals disposed in terminal cavities in the connector body.

It is already known from the U.S. Pat. No. 4,433,888 granted to James L. Winger on Feb. 28, 1984, to provide a separate lock piece which is multifunctional, that is, a lock piece which when attached to the connector body, not only prevents the withdrawl of the terminals but also provides a latch arm for securing the connector body to a mating electrical connector.

The object of this invention is to provide an electrical connector having an improved multifunction lock means which is designed to facilitate unlatching the electrical connector and disconnecting it from the mating electrical connector.

One feature of the invention is that the electrical connector has a multifunction lock means which includes a release lever which is thumb operated to unlatch the electrical connector from the mating electrical connector body.

Another feature of the invention is that the electrical connector has a multifunction lock means which may also include a trigger grip so that the electrical connector may be unlatched and disconnected from the mating electrical connector with one hand.

Other objects and features of the invention will become apparent to those skilled in the art as the disclosure is made in the following detailed description of a preferred embodiment of the invention as illustrated in the accompanying sheets of drawings in which.

Figure 1:
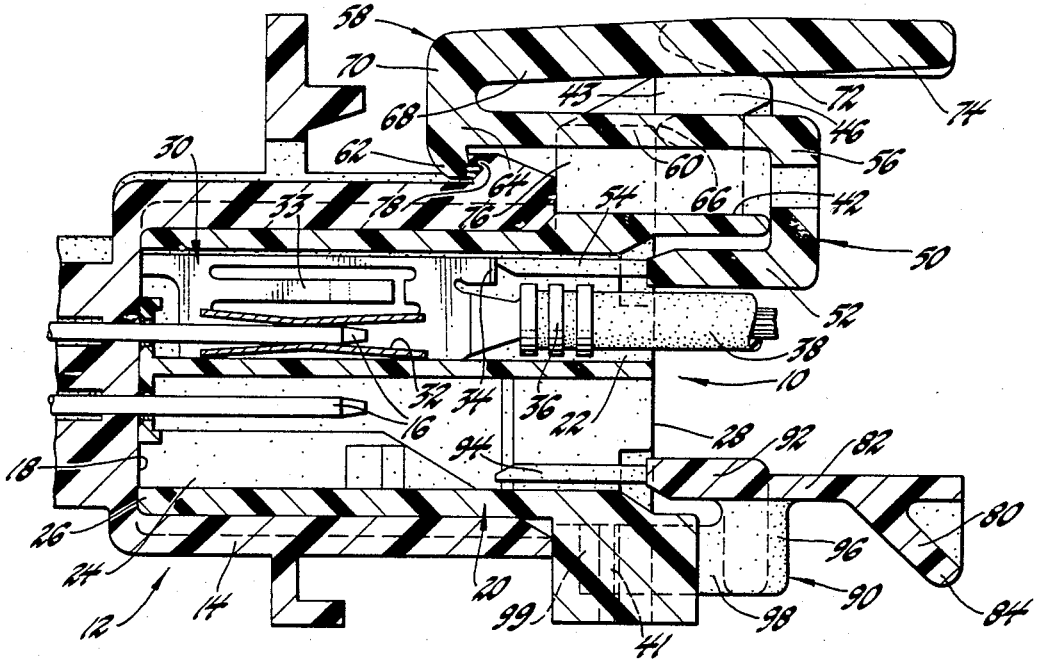
FIG. 1 is a longitudinal section of mated electrical connectors including an electrical connector having an improved multifunctional lock means in accordance with my invention.

Referring now to the drawing, my invention is illustrated as being embodied in an electrical connector 10 which is connected and latched to a mating electrical connector 12 which in this particular instance, is a header connector 14 having a plurality of pin terminals 16. The header connector 14 is attached to a printed circuit board not shown and the tails of the pin terminals 16 are soldered to various conductor strips of the circuit board, for instance, as shown in U.S. patent application Ser. No. 419,934, filed Sept. 20, 1982 now U.S. Pat. No. 4,491,376 granted Jan. 1, 1985.

The contact ends of the pin terminals 16 project into a socket 18 of the header connector 14 which is shaped to receive the connector body 20 of the electrical connector 10 which embodies my invention.

The connector body 20 has an upper row of terminal cavities 22 and a lower row of terminal cavities 24 which extend through the connector body 20 in a longitudinal direction from its contact end 26 to its conductor end 28.

Each of the terminal cavities 22 of the upper row is shaped to receive and retain a socket terminal 30 of the type shown and described in U.S. Pat. No. 4,448,477 granted to Joseph H. Gladd et al on May 15, 1984.

Briefly the terminal 30 comprises a socket 32 adapted to receive the conductor end of one of the pin terminals 16, a latch finger 33, a lock ear 34 and a crimp barre1 36 for attaching the socket terminal 30 to an electrical conductor 38.

Each of the terminal cavities 24 of the lower row is also shaped to receive and retain a socket terminal 30. It should be noted, however, that the socket terminals 30 are inserted into the cavities 24 of the lower row in an upside down position from that shown in FIGS. 1 and 2. Of course, the shape of the cavities 24 of the lower row is also upside down in comparison to the shape of the cavities 22 of the upper row.

The connector body 20 has a C-shaped channel 40 on its upper wall 42 at the conductor end 28 of the connector body 20. The C-shaped channel 40 defines a T-shaped slot comprising a center slot 43 and side slots 44 under the side pieces 46 which serve as fulcrums as explained below. Each side of the C-shaped channel 40 has a lock nib 48.

Figure 2:
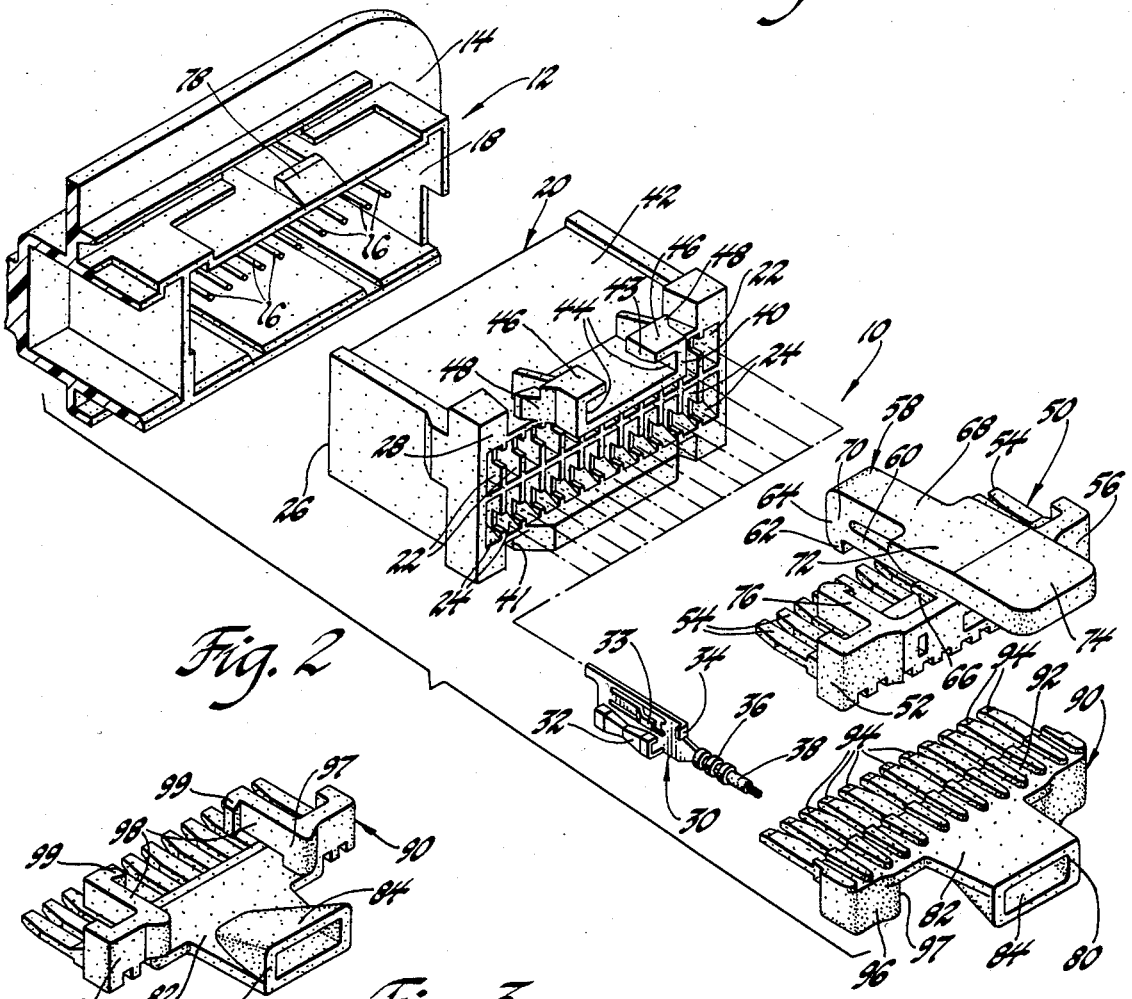
FIG. 2 is an exploded perspective view of the electrical connectors in FIG. 1.

The multifunction lock means of this invention comprises a separate lock piece 50 which includes a lock board 52 which has one end slotted to provide a plurality of individual fingers 54. These fingers enter the conductor ends of the terminal cavities 22 for disposal behind the respective lock ears 34 of the terminals 30 when the lock piece 50 is attached crosswise of the terminal cavities 22 as shown in FIG. 1. The opposite end of the lock board 52 has a flange 56 to which a U-shaped member 58 is attached. The U-shaped member 58 comprises a latch arm 60 which is attached at one end to the flange 56 and extends forwardly in cantilever fashion over the lock board 52 in the direction of the fingers 54 and which has a depending latch nib 62 at its opposite free end 64. The end portion 66 of the latch arm 60 adjacent the flange 56 is wider than the center slot 43 so that the outside edges are trapped inside the side pieces or fulcrums 46 of the C-shaped channel 40 when the lock piece 50 is attached to the connector body 30 as shown in FIG. 1.

The U-shaped member 58 further comprises a release lever 68 which is connected to the free end of the latch arm 60 by a bight 70 so that the release lever 68 extends back over the latch arm 60 with a space therebetween for receiving the fulcrums 46 as shown in FIG. 1. The release lever 68 has a wide mid-portion 72 which is wider than the center slot 43 so that it engages the fulcrums 46 on either side of the center slot 43. The release lever 68 also has a corresponding wide end portion 74 which serves a thumb pad which is located rearwardly of the fulcrums 46 and the attached end portion 66 of the latch arm 60 so that the latch nib 62 moves away from the connector body 20 when the thumb pad 74 is depressed.

The separate lock piece 50 also has two short latch arms 76 projecting forwardly from flange 56 on either side of the U-shaped member 58 for engaging the lock nibs 48 to secure the separate lock piece 50 to the connector body 20.

After the terminals 30 are inserted in the terminal cavities 22 and retained therein by the latch tangs 33, the separate lock piece 50 is then attached to the connector body 20 by inserting the fingers 54 into the conductor ends of the terminal cavities 22 until the short latch arms 76 snap past the lock nibs 48 to secure the lock piece 50 in the attached position shown in FIG. 1. In this attached position, the fingers 54 are disposed behind the lock ears 34 of the respective terminals 30 in the cavities 22 to provide a solid lock which prevents withdrawal of the terminals 30 from the cavities 22; and the wide end portion 66 of the latch arm 60 is trapped beneath the fulcrums 46 which positions the latch arm 60 so that the latch nib 62 engages behind the cooperating lock nib 78 of the header connector 14 under the force of a bending moment when the two electrical connectors are subsequently connected and latched together as shown in FIG. 1. The electrical connectors 10 and 12 may be unlatched simply by depressing the release lever 68 at the thumb pad 74.

The multifunction lock means of my invention may also include a trigger grip 80 to assist in unlatching and disconnecting the electrical connector 10 from the electrical connector 12.

The trigger grip 80 is connected to the connector body 20 so that it extends rearwardly of the connector body 20 generally parallel to and about an inch or two below the U-shaped member 58 so that the thumb pad 74 and trigger grip 80 may be engaged by one hand of an operator for releasing the latch nib 62 and disconnecting the electrical connector 10 from the electrical connector 12. More specifically, the trigger grip 80 comprises an extension 82 and a depending triangular finger piece 84 at the end of the extension. The index finger of the operator is wrapped around the finger piece 84 and the thumb pad 74 is depressed which releases the latch nib 62 as indicated above. The released electrical connector 10 remains firmly gripped by the operator so that it may be disconnected from the electrical connector 12 simply by pulling the electrical connector 10 out of the socket 18.

In instances where the electrical connector 10 is of the double row type, the trigger grip 80 may be incorporated into a second separate lock piece 90 for the terminals 30 which are disposed in the terminal cavities 24 of the lower row.

Like the lock piece 50, the lock piece 90 also includes a lock board 92 which has one end slotted to provide a plurality of individual fingers 94 which are disposed behind the respective lock ears 34 of the terminals 30 in the terminal cavities 24 when the lock piece 90 is attached crosswise of the terminal cavities 24 as shown in FIG. 1. The opposite end of the lock board 92 likewise has a flange 96 to which two short latch arms 98 are attached so as to project forwardly for engaging cooperating lock nibs 41 depending from the lower wall of the connector body 20 to secure the second lock piece 90 to the connector body 20. The trigger grip 80 also extends from the opposite end of the lock board 92 in line with a large central slot 97 which extends through the flange 96 to facilitate molding the lock nibs 99 on the ends of the short latch arms 98 and the finger piece 84 on the end of the extension 82.

Figure 3:
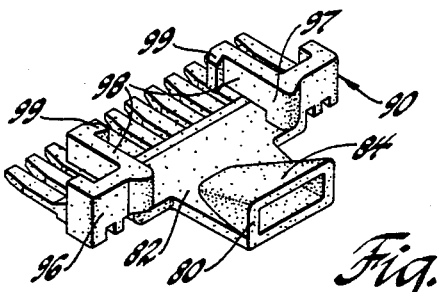
FIG. 3 is a perspective view of the lower lock piece of FIGS. 1 and 2 shown in an upside down position.

The lock pieces 50 and 90 retain the terminals in the cavitities and secure their respective lock boards to the connector body in substantially the same way and are constructed substantially identical in this regard. The second lock piece 90 and the trigger grip 80 incorporated therewith are shown upside down in FIG. 3 to better illustrate the second lock piece 90 and demonstrate the similarity with the lock piece 50.

I wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical connector comprising a connector body having a row of terminal cavities and a plurality of terminals disposed in the respective terminal cavities of the said row; and multifunction lock means for preventing withdrawal of the terminals disposed in the row of terminal cavities and latching the connector body to a mating electrical connector, said multifunction lock means comprising;

a separate lock piece which includes a lock board which is disposed crosswise of the row of terminal cavities and which has an end portion disposed in the terminal cavities at a conductor end of the connector body to prevent withdrawal of the terminals disposed therein, said lock piece further comprising a U-shaped member including a latch arm which is attached at one end to the opposite end portion of the lock board and which extends forwardly in cantilever fashion over the lock board, said latch arm having a latch nib at its opposite free end, said U-shaped member further including a release lever which is connected to the opposite free end of the latch arm by a bight and which extends back over the latch arm with a space therebetween, and said lock piece having means for attaching the lock piece to the connector body.

2. An electrical connector comprising a connector body having a row of terminal cavities and a plurality of terminals disposed in the respective terminal cavities of the said row; and multifunction lock means for preventing withdrawal of the terminals disposed in the row of terminal cavities and latching the connector body to a mating electrical connector, said multifunction lock means comprising;

a separate lock piece which includes a lock board which is disposed crosswise of the row of terminal cavities, and which has an end portion disposed in the terminal cavities at a rearward end of the connector body to prevent withdrawal of the terminals disposed therein, said lock piece further comprising a U-shaped member including a latch arm which is attached at one end to the opposite end portion of the lock board and which extends forwardly in cantilever fashion over the lock board, said latch arm, having a latch nib at its opposite free end, said U-shaped member further including a release lever which is connected to the opposite free end of the latch arm by a bight and which extends back over the latch arm with a space therebetween, said release lever having a thumb pad at its free end which is located rearwardly of the attached end of the latch arm, said lock piece having means for attaching the lock piece to the connector body and, a trigger member connected to the connector body so that it extends rearwardly of the connector body generally parallel to the U-shaped member so that the trigger member and the thumb pad may be engaged by the index finger and thumb of one hand of an operator for releasing the latch nib and disconnecting the electrical connector from a mating electrical connector.

3. An electrical connector comprising a connector body having a row of terminal cavities and a plurality of terminals disposed in the respective terminal cavities of the said row; and multifunction lock means for preventing withdrawal of the terminals disposed in the row of terminal cavities and latching the connector body to a mating electrical connector, said multifunction lock means comprising;

a lock piece which includes a lock board which is disposed crosswise of the row of terminal cavities, and which has an end portion disposed in the terminal cavities at a rearward end of the connector body to prevent withdrawal of the terminals disposed therein, said lock piece further comprising a U-shaped member which includes a latch arm which is attached at one end to a flange at the opposite end portion of the lock board and which extends forwardly in cantilever fashion over the lock board, said latch arm having a latch nib at its opposite free end, said U-shaped member further including a release lever which is connected to the opposite free end of the latch arm by a bight and which extends back over the latch arm with a space therebetween, said release lever having a mid-portion engaging a fulcrum of the connector body, and a thumb pad at its a free end which is located rearwardly of the fulcrum and the attached end of the latch arm so that the latch nib moves away from the connector body when the thumb pad is depressed, said lock piece having means for attaching the lock piece to the connector body, and a trigger grip connected to the connector body so that it extends rearwardly of the connector body generally parallel to the U-shaped member so that the trigger grip and the thumb pad may be engaged by the index finger and thumb of one hand of an operator for releasing the latch nib and disconnecting the electrical connector from a mating electrical connector.

4. The electrical connector as defined in claim 3 wherein the connector body has a C-shaped channel which defines a T-shaped slot comprising a center slot and side slots under flange pieces of the C-shaped channel, wherein, the latch arm has a widened end portion adjacent the flange which is trapped beneath the flange pieces of the C-shaped channel, and wherein the flange pieces serve as the fulcrum engaged by the mid-portion of the release lever.

5. An electrical connector comprising a connector body having a first row and a second row of terminal cavities and a plurality of terminals disposed in the respective terminal cavities of the said rows; and multifunction lock means for preventing withdrawal of the terminal disposed in the rows of terminal cavities and latching the connector body to a mating electrical connector, said multifunction lock means comprising;

a first lock piece which includes a first lock board which is disposed crosswise of the first row of terminal cavities and which has an end portion disposed in the terminal cavities of the first row at a rearward end of the connector body to prevent withdrawal of the terminals disposed therein, said first lock piece further comprising a U-shaped member which includes a latch arm which is attached to the opposite end portion of the first lock board and extends forwardly in cantilever fashion, over the first lock board, said latch arm having a latch nib at its opposite free end, said U-shaped member further including a release lever which is connected to the opposite free end of the latch arm by a bight and which extends back over the latch arm with a space therebetween;

said release lever having a thumb pad at its free end which is located rearwardly of the attached end of the latch arm, a second lock piece which includes a second lock board which is disposed crosswise of the second row of terminal cavities, and which has an end portion disposed in the terminal cavities of the second row at the rearward end of the connector body to prevent withdrawal of the terminals disposed therein, said second lock piece further including a trigger grip having an extension with a depending finger piece at the free end thereof, said extension being attached to the opposite end portion of the second lock board and extending rearwardly of the connector body generally parallel to the U-shaped member so that the finger piece and the thumb pad may be engaged by the index finger and thumb of one hand of an operator for releasing the latch nib and disconnecting the electrical connector from a mating electrical connector, and said multifunction lock means having means for attaching the first and second lock pieces to the connector body.

* * * * *